US006156410A

United States Patent [19]

Bassler

[11] Patent Number: 6,156,410

[45] Date of Patent: Dec. 5, 2000

[54] HOODED TOWEL COVERING

[76] Inventor: Patricia Rosann Bassler, 606 E. 5th St., Trenton, Ill. 62293

[21] Appl. No.: 09/411,691

[22] Filed: Oct. 1, 1999

[51] Int. Cl.[7] ..... B32B 23/02

[52] U.S. Cl. ..... 428/193; 428/192; 428/197; 428/220; 428/221; 428/223

[58] Field of Search ..... 428/221, 223, 428/220, 197, 193, 192

[56] References Cited

U.S. PATENT DOCUMENTS 4,725,094 2/1988 Geer ..... 297/229

*Primary Examiner*—Merrick Dixon
*Attorney, Agent, or Firm*—Anthony R. Johnson

[57] ABSTRACT

The specification relates to an article of manufacture for a hooded towel covering being comprised of a towel and a hood located in the middle of one of the towel's edges.

4 Claims, 3 Drawing Sheets

HOODED TOWEL COVERING

BACKGROUND OF THE INVENTION

1. Field of the Invention

This invention is concerned with articles of clothing, and specifically towels and cover up articles of clothing. Ideally, the invention is used to wrap around a baby or young child after the child has been swimming or taken a bath or shower.

2. Related Prior Art

It is known that one may wrap up a baby or young child in a towel. In fact, it is known that one may wrap up a baby or young child in a towel with a hood. However, it has not been known heretofore how to make a hooded towel covering with which to wrap up a baby or young child, and which completely covers the baby or child, and which is soft to the touch, and which is cost efficient to make and profitable to market, and which is aesthetically pleasing to view, and which may be customized to identify the end user of the Hooded Towel Covering, all as disclosed herein.

SUMMARY OF THE INVENTION

The inventor's invention is an article of manufacture, specifically an article of clothing. The article is a hooded towel covering being comprised of a towel and a hood located in the middle of one of the towel's edges. The covering may be used to wrap up a baby or young child, completely covers the baby or child, is soft to the touch, is cost efficient to make and profitable to market, and is aesthetically pleasing to view. It also may be customized to identify the end user of Hooded Towel Covering.

In accordance with a first embodiment of the invention, the covering is comprised of a towel having a top edge, a bottom edge, a right edge and a left edge; a hood fixed to the top edge of the towel; the hood being made from a rectangular piece of cloth having a first edge, a second edge opposite the first edge, a third edge perpendicular to both the first and second edges and a fourth edge opposite the third edge; the hood being doubled such that the first edge and the second edge meet and the left one half of the third edge being rigidly sewn to the right one half of the third edge; and the hood being fixed to the top edge by having the first edge and second edge of the hood sewn to the top edge of the towel from a point approximately one fourth of the way from the right edge of the towel to a point approximately three fourths of the way from the right edge of the towel.

BRIEF DESCRIPTION OF THE DRAWINGS(S)

Figure 1:
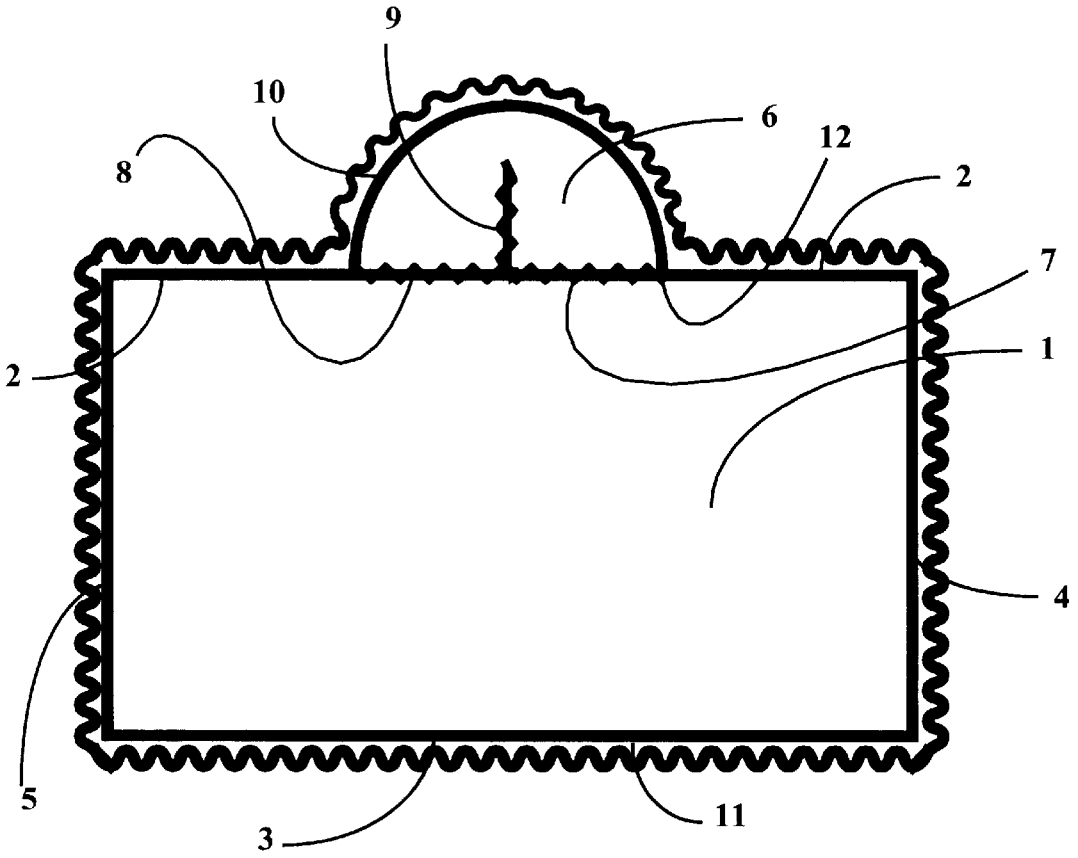
FIG. 1 is a front view of the hooded towel covering.
Figure 2:
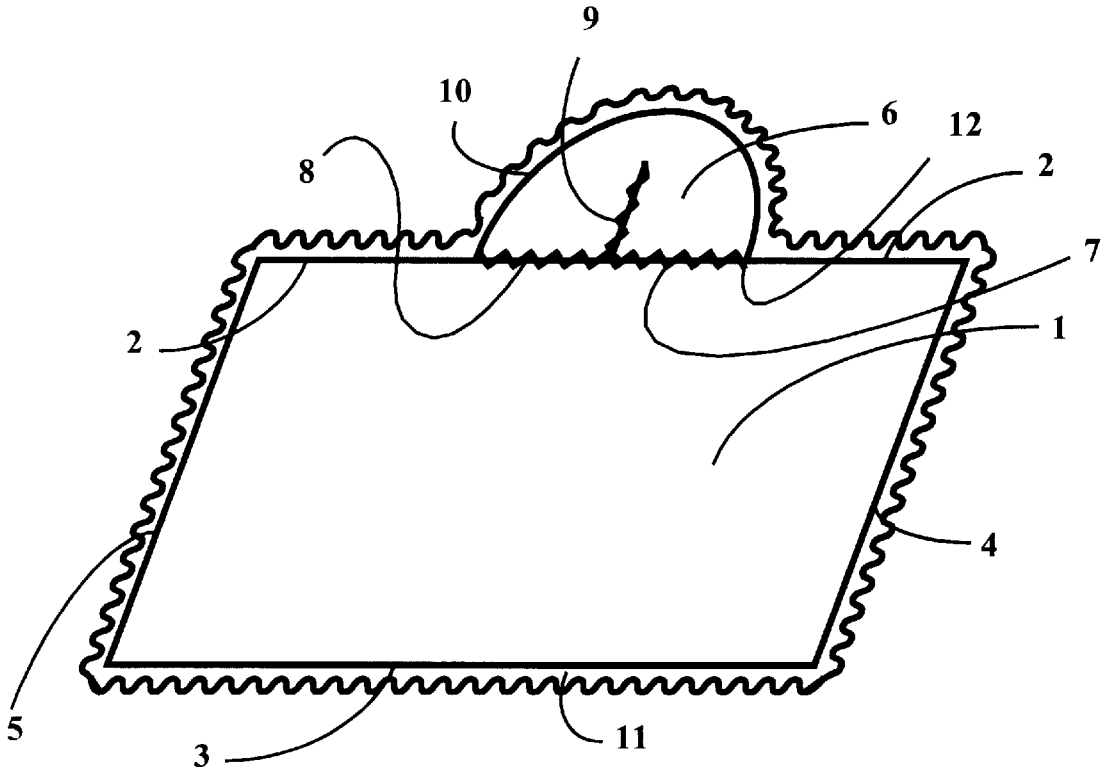
FIG. 2 is a side view of the hooded towel covering.
Figure 3:
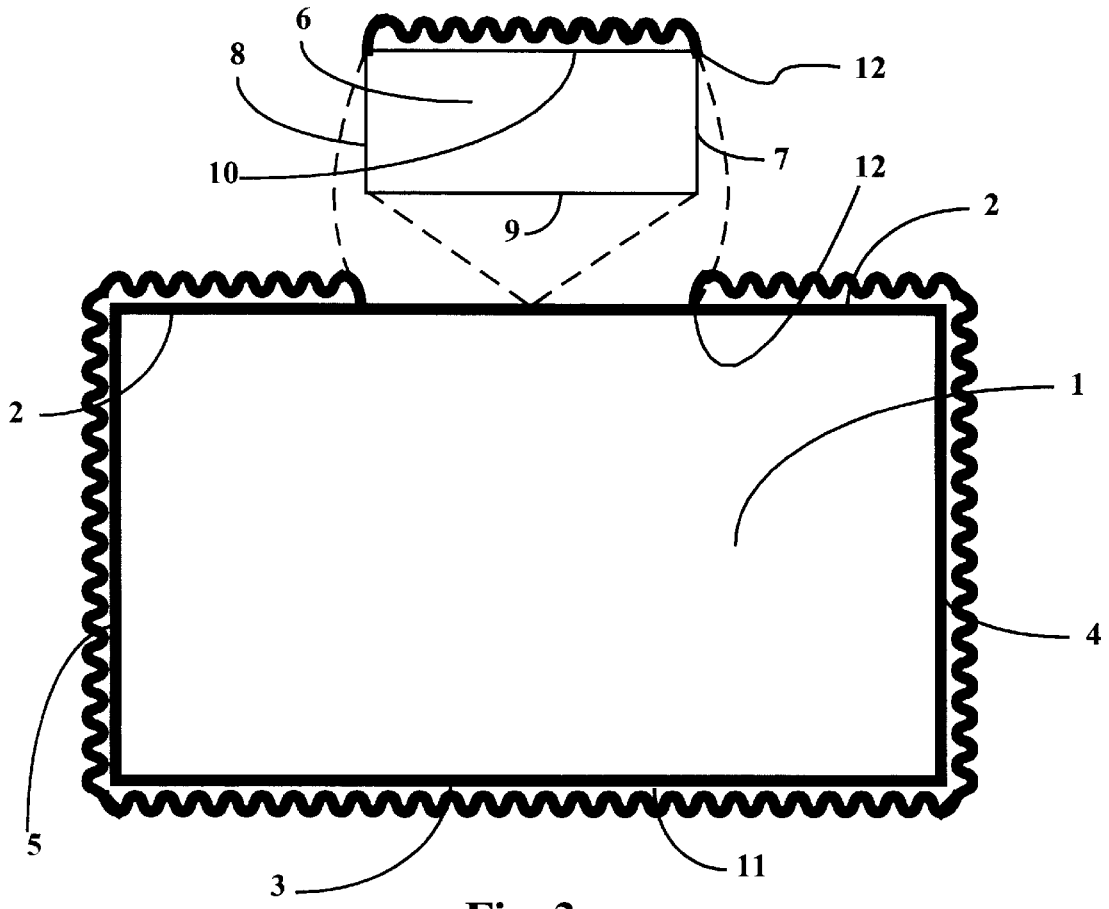
FIG. 3 is a view of the separate towel and hood components.

In the drawings, the following designations are shown and referred to in this specification:

Towel 1

Top Edge of Towel 2

Bottom Edge of Towel 3

Right Edge of Towel 4

Left Edge of Towel 5

Hood 6

First Edge of Hood 7

Second Edge of Hood 8

Third Edge of Hood 9

Fourth Edge of Hood 10

Lace Border 11

Starting Point of Lace Border 12

DESCRIPTION OF THE PREFERRED EMBODIMENT(S)

In the preferred embodiment of the invention, the covering is comprised of a towel 1 having a top edge 2, a bottom edge 3, a right edge 4 and a left edge 5; a hood 6 fixed to the top edge 2 of the towel 1; the hood 6 being made from a rectangular piece of cloth having a first edge 7, a second edge 8 opposite the first edge 7, a third edge 9 perpendicular to both the first 7 and second edges 8 and a fourth edge 10 opposite the third edge 9; the hood 6 being doubled such that the first edge 7 and the second edge 8 meet and the left one half of the third edge 9 being rigidly sewn to the right one half of the third edge 9; and the hood 6 being fixed to the top edge 2 by having the first edge 7 and second edge 8 of the hood 6 sewn to the top edge 2 of the towel 1 from a point approximately one fourth of the way from the right edge 4 of the towel 1 to a point approximately three fourths of the way from the right edge 4 of the towel 1.

A further embodiment is further comprised of a lace border 11 fixed to the outer edges 2, 4, 3, 5, 2 & 10 of the covering from a starting point 12 at the top edge 2 of the towel 1 at a point one fourth of the way from the right edge 4 of the towel 1, along the top edge 2 of the towel 1 to the right edge 4 of the towel 1, along the right edge 4 of the towel 1 to the bottom edge 3 of the towel 1, along the bottom edge 3 of the towel 1 to the left edge 5 of the towel 1, along the left edge 5 of the towel 1 to the top edge 2 of the towel 1, along the top edge 2 of the towel 1 to the point approximately three fourths of the way from the right edge 4 of the towel 1, and along the fourth edge 10 of the hood 6 back to the starting point 12.

A further and preferred embodiment of the invention is comprised of a towel 1 having a right edge 4 being 30 to 32 inches long, a left edge 5 being 30 to 32 inches long, a top edge 2 being 51 to 53 inches long and a bottom edge 3 being 51 to 53 inches long. Also, the preferred embodiment is comprised of a hood 6 having a first edge 7 being 11 to 13 inches long, a second edge 8 being 11 to 13 inches long, a third edge 9 being 14 to 16 inches long, and a fourth edge 10 being 14 to 16 inches long.

Moreover further embodiments of the article are achieved by customizing it to identify the end user. For example, the end user's monogram, name or other identifying mark may be sewn or otherwise affixed to the towel 1 and/or hood 6 portion of the covering.

Having set forth the general nature and specific embodiments of the present article of manufacture, the true scope is now particularly pointed out in the appended claims.

What is claimed is:

1. A covering comprising:

a towel;

said towel having a top edge, a bottom edge, a right edge and a left edge;

a hood fixed to the top edge of the towel;

said hood being made from a rectangular piece of cloth having a first edge, a second edge opposite the first edge, a third edge perpendicular to both the first and second edges and a fourth edge opposite the third edge;

said hood being doubled such that the first edge and the second edge meet and the left one half of the third edge being rigidly sewn to the right one half of the third edge; and said hood being fixed to the top edge by having the first edge and second edge of the hood sewn to the top edge of the towel from a point approximately one fourth of the way from the right edge of the towel to a point approximately three fourths of the way from the right edge of the towel.

2. The covering according to claim 1 wherein:

a lace border is fixed to the outer edges of the covering from a starting point at the top edge of the towel at a point one fourth of the way from the right edge of the towel, along the top edge of the towel to the right edge of the towel, along the right edge of the towel to the bottom edge of the towel, along the bottom edge of the towel to the left edge of the towel, along the left edge of the towel to the top edge of the towel, along the top edge of the towel to the point approximately three fourths of the way from the right edge of the towel, and along the fourth edge of the hood back to the starting point.

3. The covering according to claim 1 wherein:

the right edge of the towel is 30 to 32 inches long;

the left edge of the towel is 30 to 32 inches long;

the top edge of the towel is 51 to 53 inches long;

the bottom edge of the towel is 51 to 53 inches long;

the first edge of the hood is 11 to 13 inches long;

the second edge of the hood is 11 to 13 inches long;

the third edge of the hood is 14 to 16 inches long; and the fourth edge of the hood is 14 to 16 inches long.

4. The covering according to claim 1 wherein:

a lace border is fixed to the outer edges of the covering from a starting point at the top edge of the towel at a point one fourth of the way from the right edge of the towel, along the top edge of the towel to the right edge of the towel, along the right edge of the towel to the bottom edge of the towel, along the bottom edge of the towel to the left edge of the towel, along the left edge of the towel to the top edge of the towel, along the top edge of the towel to the point approximately three fourths of the way from the right edge of the towel, and along the fourth edge of the hood back to the starting point;

the right edge of the towel is 30 to 32 inches long;

the left edge of the towel is 30 to 32 inches long;

the top edge of the towel is 51 to 53 inches long;

the bottom edge of the towel is 51 to 53 inches long;

the first edge of the hood is 11 to 13 inches long;

the second edge of the hood is 11 to 13 inches long;

the third edge of the hood is 14 to 16 inches long; and the fourth edge of the hood is 14 to 16 inches long.

* * * * *